United States Patent [19]

Stiller et al.

[11] 4,396,491

[45] Aug. 2, 1983

[54] SOLVENT EXTRACTION OF OIL SHALE OR TAR SANDS

[76] Inventors: Alfred H. Stiller, 459 Lawnview Cir.; John T. Sears, 200 Jackson Ave., both of Morgantown, W. Va. 26505; Richard W. Hammack, 9837 Presidential Dr., Apt. 104, Allison Park, Pa. 15101

[21] Appl. No.: 386,795

[22] Filed: Jun. 8, 1982

[51] Int. Cl.[3] ..... C10G 1/04

[52] U.S. Cl. ..... 208/11 LE; 208/8 LE

[58] Field of Search ..... 208/11 LE, 8 LE, 8 R, 208/11 R

[56] References Cited

U.S. PATENT DOCUMENTS 4,242,195 12/1980 Rudwick ..... 208/11 LE 4,272,356 6/1981 Stiller et al. ..... 208/11 LE

*Primary Examiner*—Delbert E. Gantz

*Assistant Examiner*—A. Pal

*Attorney, Agent, or Firm*—Mason, Fenwick & Lawrence

[57] ABSTRACT

Oil shale or tar sands is extracted under non-thermally destructive conditions with a solvent liquid containing a compound having the general formula:

where

M is a carbon, sulfur, or phosphorus atom, $R^2$ and $R^3$ are each a hydrogen atom or a lower alkyl group, R and $R^1$ are each a lower alkyl group, another a monocyclic aromatic group, or $R^1$ can be another or $R^1$ and $R^2$ together can represent the atoms necessary to close a heterocyclic ring, and n=1 where M=phosphorus and is otherwise 0, to substantially remove the non-fixed carbon content of the oil shale or tar sands, leaving a solid residue of fixed carbon, ash minerals, and non-extractable matter.

9 Claims, 1 Drawing Figure

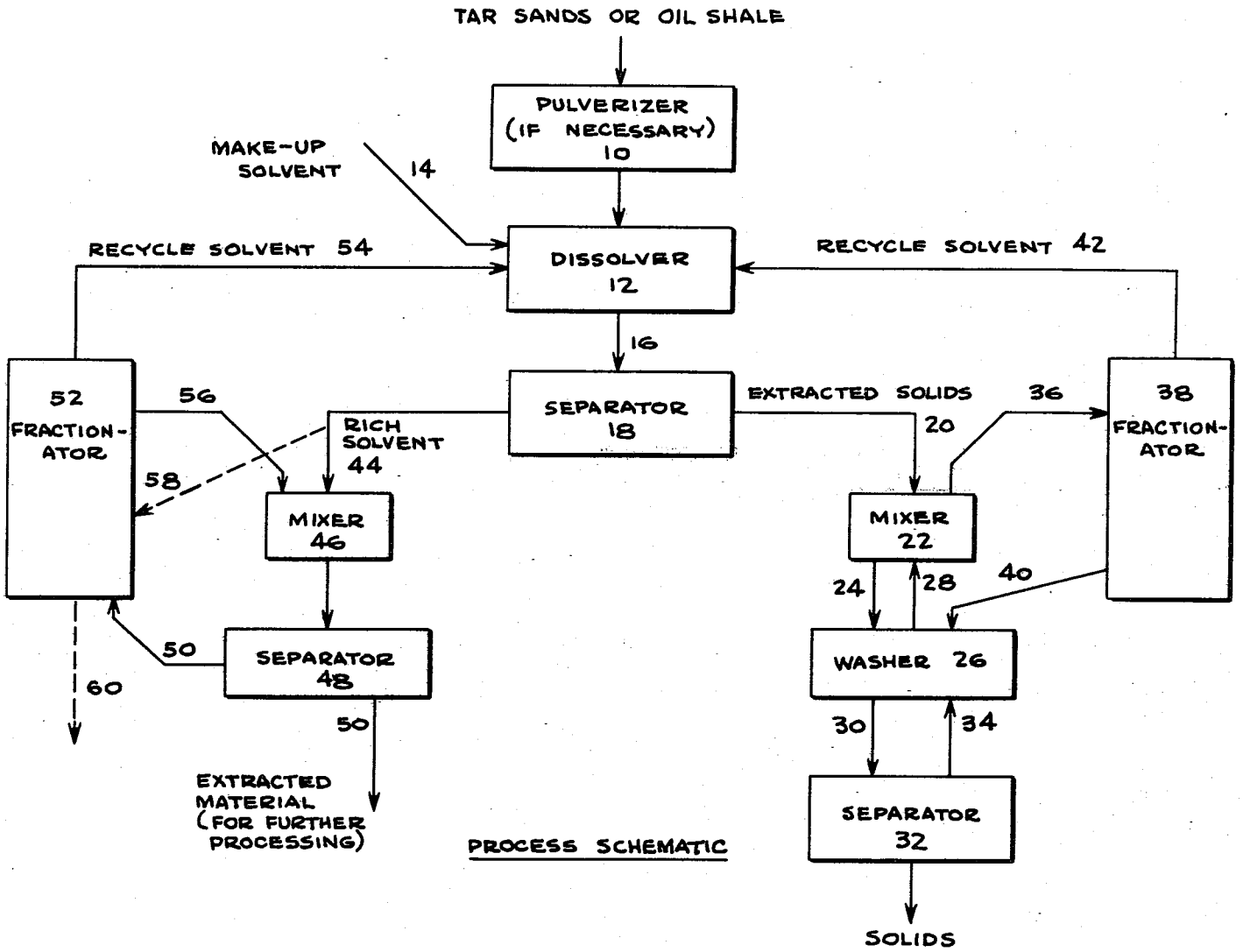
TAR SANDS OR OIL SHALE
PULVERIZER (IF NECESSARY) 10
DISSOLVER 12
16
SEPARATOR 18
EXTRACTED SOLIDS 20
RECYCLE SOLVENT 42
38 FRACTION-ATOR
36
40
MIXER 22
28
24
WASHER 26
34
30
SEPARATOR 32
SOLIDS
PROCESS SCHEMATIC
14
MAKE-UP SOLVENT
RECYCLE SOLVENT 54
RICH SOLVENT 44
MIXER 46
SEPARATOR 48
50
EXTRACTED MATERIAL (FOR FURTHER PROCESSING)
56
58
52 FRACTION-ATOR
60

SOLVENT EXTRACTION OF OIL SHALE OR TAR SANDS

CROSS-REFERENCE TO RELATED INVENTIONS

The subject matter of this application is related to that of application Ser. No. 137,829, filed Apr. 7, 1980, now U.S. Pat. No. 4,272,356 issued June 9, 1981.

FIELD OF THE INVENTION

This invention relates to a process for extracting oil shale or tar sands, and is directed more exactly to an improved extraction process carried out under non-thermally destructive conditions to permit substantial recovery of the non-fixed carbon content of the oil shale or tar sands.

BACKGROUND OF THE INVENTION

The mineral coal is a complex mineral of widely varying composition and structure, dependent upon the location and conditions under which it was formed in nature. In general, coal is classified or ranked according to its content of volatile matter which can range from around 50% or more for lignote or cannel coal to about 20–30% for a middle rank bituminous, gas or coking to 10% or less for a high ranking bituminous coal or anthracite, the remainder being constituted by non-volatile or fixed carbon together with minor amounts of about 8% or so each of ash and moisture.

Pyrolytic destructive distillation has been the typical approach for fuel and resource extraction from coal. In all cases, volatile tars and oils are driven off, and a non-volatile solid residue (called coke) remains. These products are remarkably similar considering the variability in starting material. Coke from coal has long been valuable as a fuel in the production of iron and steel and in the production of gases for heating and illumination. Volatile tars and oils are valuable in themselves by virtue of the inclusion therein of a large number of organic chemicals having valuable utility in industry in themselves or as intermediates for the formation of technologically important derivatives. There are now known to be contained in coal tar extracted from coal nearly 300 different organic chemical compounds including benzene and its alkylated and partially or totally hydrogenated derivatives, styrene, naphthalene, and anthracene and their derivatives together with numerous other carbocyclic and heterocyclic hydrocarbons, particularly those based on fused ring systems.

The temperature and other conditions of the pyrolytic decomposition or carbonization of coal can vary considerably in order to tailor the output of known processes to exaggerate the formation of certain particularly desirable compounds. Where the process conditions are selected as to be especially severe, it is usually referred to as a gasification process, the object of these conditions being to magnify the gaseous content of the reaction as greatly as possible. These vapor phase products can be condensed to produce oil fractions useful directly or by intermediate conversion, as by catalytic reforming and/or cracking as diesel oil and gasoline for internal combustion engines. Direct hydrocarbonization gasification processes subject coal to hydrogen gas under pressure in the order of about 50–100 atmospheres and are consequently expensive and difficult to practice, although such processes have become increasingly the object of concentrated research as an alternative source of internal combustion engine fuel to natural petroleum.

Coal can be subjected to so-called direct liquefaction processes in which the coal is treated under less severe conditions than utilized for carbonization and gasification, usually under pressure at temperatures below about 600° C. at which substantial gas formation is initiated. Even at these conditions, coal is difficult to dissolve, and heavy attention has been directed in research in this field to the identification of solvents capable of dissolving the coal. For the most part, the solvents found to be more or less effective have been based on hydrogen-rich or protonic organic liquids, usually derived from the coal itself or as specialized by-products from the distillation and fractionation of petroleum, having a chemical structure adapted to compensate the natural hydrogen deficiency of coal which tends to impede its dissolution. Such processes are frequently carried out under high pressure in a hydrogen atmosphere to make available additional hydrogen atoms for combination with the coal. The following is a list of patents which relate to this kind of coal liquefaction process:

| | | | |
|---|---|---|---|
| 2,572,061 | 3,705,092 | 3,867,275 | 4,052,291 |
| 3,375,188 | 3,726,785 | 3,870,621 | 4,052,292 |
| 3,379,638 | 3,849,287 | 3,956,436 | 4,189,373 |
| 3,642,608 | 3,852,183 | 4,040,941 | |

Even though a fraction of the reaction products from the direct liquefaction process may be withdrawn and recycled for combination with fresh amounts of coal, these processes are fundamentally independent of the derivation of solvents directly from natural energy materials which might be better used for their usual purposes. In addition, versions of these processes can be carried out in the presence of finely divided solid catalysts serving to increase the efficiency of the reaction and/or bias the reaction toward the formation of particularly desirable end products such as gasoline and diesel oil. These catalysts inherently tend to become poisoned in time so as to lose their effectiveness. Separation and purification steps for the liquefaction products are seriously susceptible to clogging which requires cleaning and replacement from time to time.

In the rare instances in the art where coal has been subjected to simple extraction, e.g. U.S. Pat. No. 2,242,822, preliminary oxidation of the coal has been indispensable to convert it into a form susceptible to dissolution in furfural and furane derivatives employed as solvents.

Oil shale and tar sands, similarly, vary widely in composition and structure, although both are considered to be greatly enriched in aliphatic material relative to coal. Oil shales can exist as true shale containing trapped tars and hydrocarbons, or as marls (carbonate rocks containing tars and hydrocarbons). Tar sands exist primarily as sandstones containing heavy tars and pitches. Organic content typically ranges from 4% to 60% of the total mined weight. These substances, consequently, contain valuable components generally in the same manner as coal and it would be advantageous to be able to recover at least some of such substances from these sources.

It is known to upgrade oils and tars extracted from oil shale by direct hydrogenation, and oil shale has been subjected to pyrolytic extracting according to U.S. Pat.

Nos. 3,661,423 and 3,736,247 to produce a coke-like product, known in the art as petroleum coke. Prior work devoted to the extraction of oils from tar sands is described in the following U.S. Patents:

| | | | |
|---|---|---|---|
| 3,623,971 | 3,844,937 | 3,953,317 | 4,242,195 |
| 3,811,506 | 3,925,189 | 4,054,506 | 4,238,315 |
| 3,802,508 | 3,913,672 | 4,120,775 | 4,250,964 |
| 3,856,464 | 3,951,457 | 4,139,450 | 4,248,683 |
| | 3,941,679 | | 4,284,139 |

SUMMARY OF THE INVENTION

It has now been discovered that the special class of solvents which was disclosed and claimed as useful in the extraction of coal to remove non-fixed carbon content thereof in U.S. Pat. No. 4,272,356 identified above is also useful for the extraction of oil shale and tar sands likewise to remove the non-fixed carbon content of these natural materials to produce a solid residue containing the fixed carbon content thereof.

OBJECTIVES OF THE INVENTION

The ultimate object of the present invention is the provision of a process for the extraction of oil shale or tar sands, using a special solvent which exerts solvent action on these materials under mild processing conditions at temperatures below 300° C.

A further feature of the inventive process is the availability of simple measures for separating the extraction solvent from both the dissolved and residual undissolved matter of the oils shale or tar sands which permits recovery of the solvent for use in further extraction.

A further feature of the invention is an extraction process which does not generate substantial amounts of vapor phase products and consequently does not require special equipment for handling these products.

A further feature of the inventive process is the separation from oil shale or tar sands of a solid residue of non-extractable matter, mainly inorganic minerals and mineral carbon, which is readily recoverable in activated form suitable for a variety of industrial uses.

BRIEF DESCRIPTION OF THE DRAWING

These and other objects and advantages will be apparent from the following detailed description when read in conjunction with the accompanying drawing which is a diagrammatic flow sheet of one embodiment of process embodying the present invention.

DETAILED DESCRIPTION OF THE INVENTION

All known types of oil shale and tar sands are, in principle, suitable for treatment in accordance with the present invention; although as will be understood, the selection of a particular type to be treated may directly influence the nature of the ultimate end products, and different types of starting material will necessarily result in a different make-up of end products. Obviously, the conditions of pyrolytic decomposition even at the mild end of the spectrum must cause side reactions in which nominally non-volatile matter is decomposed or cracked into lesser components which either directly or after recombination with other components go into the gaseous state, while nominally volatile matter may either directly or after similar decomposition or cracking undergo combination, e.g. polymerization or the like, or reaction with parts of the nominally solid matter or decomposition products thereof to produce non-volatile end products. Thus, the volatile and non-volatile carbon content according to classical analysis cannot in general be presumed to correspond to the actual starting proportions of these materials in the natural oil shale or tar sands, since the end quantities thereof are not independent of the reaction but are in significant measure a function of reaction conditions, including time as well as temperature and pressure.

In the present invention, the extraction process is carried out under non-thermally destructive conditions in the context of which the classical terminology is inappropriate and needs to be replaced by the terminology fixed carbon and non-fixed or mobile carbon, respectively. The significance of these terms is more fully understood if fossil fuels are, in general, visualized in terms of a framework or matrix of carbon black structure as a non-crystalline collection of graphite-like plates, onto which is absorbed a coating of tar-like material. Compared to coal, oil shale and tar sands are basically similar but contain much less of the carbon black matrix or graphite-like plates. The surface tars fall into two general categories: namely, bitumens including all compounds susceptible to extraction by classical organic solvents, and kerogen including the compounds which resist classical solvent extraction. According to the present invention, essentially all of the bitumen is extracted together with a significant amount or even the bulk of the kerogen without the necessity for thermal destruction of the oil shale or tar sands.

The aforegoing discussion helps to explain the scope of application of the process of the invention. To the extent that the oil shale or tar sands to be treated contain non-fixed carbon (and all natural oils and tars have at least a minor content of this matter), then the present process is useful for the purposes of removing from that material at least a substantial portion of whatever non-fixed carbon content it naturally contains. Furthermore, the fixed carbon content of the particular material is also improved by the present process which in removing the tars from the pores of the fixed carbon matrix renders the same more responsive to whatever end utility the particular residual solids might be intended.

The oil shale or tar sands are, if not naturally so, mechanically sub-divided for purposes of the present extraction treatment, but the size of the particles thus sub-divided is not critical. As with any contact process, the rate of the extraction tends to increase as the surface area of the material being extracted increases and, consequently, advantage can be taken of this common principle by sub-dividing it to fairly fine size. Particles passing through a 200 mesh screen have been found to be a convenient size from a practical standpoint. Particles within the range between 12 and 250 mesh should be effective for present purposes but, as previously indicated, the particle size is not critical and particles larger or smaller than this range might well prove useful.

The essential solvating component of the solvent medium used in the extraction process of the present invention is a compound or liquid mixture of compounds with the following general formula:

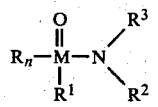

where

M is a carbon, sulfur, or phosphorus atom, $R^2$ and $R^3$ are each a hydrogen atom or a lower alkyl group, R and $R^1$ are each a lower alkyl group, another

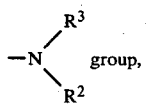

a monocyclic aromatic group, or $R^1$ can be another

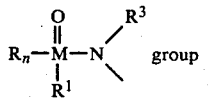

or $R^1$ and $R^2$ together can represent the atoms necessary to close a heterocyclic ring, and n=1 where M=phosphorus and is otherwise 0.

Where $R_n$ and $R^1$ are either or both lower alkyl groups in this formula, alkyl can apparently have a carbon content in the range of $C_1$–$C_4$ or possibly $C_5$, of which $C_1$ and $C_2$ are considered preferable. Preferred substituents for $R^2$ and $R^3$ are methyl and ethyl groups, although it is presumed that homologs up to about $C_4$ or possibly higher would produce more or less useful solvent compounds, and the replacement of such groups with one or more hydrogen atoms also appears to be an acceptable alternative. Monocyclic aromatic groups such as a benzyl radical might also prove useful as the substituent $R^1$ or $R^2$, because the structure of this group is favorable to the resonance stabilizing function of the solvent. In selecting the combination of specific groups for the substituents $R^1$, $R^2$, $R^3$, one should avoid the inclusion in the solvent compound molecule of so large a number of carbon atoms, considered collectively for all of the substituent groups, as would impair the requisite solvent properties, but subject to this overriding criterion, a considerable variety of substituent groups are conceivable and, as between $R^2$, and $R^3$, the substituent groups need not be the same. Specific preferred solvent compounds within the above formula include tetramethylurea (TMU) of the formula $(CH_3)_2N—CO—N(CH_3)_2$, N,N-dimethylacetamide (DMAA) of the formula $CH_3—CO—N(CH_3)_2$, hexamethylphoshoramide (HMPA) of the formula $(CH_3)_2N—PO[—N(CH_3)_2]_2$, tetramethylamide sulfoxide of the formula $(CH_3)_2N—SO—N(CH_3)_2$. Where $R^2$ and either $R^1$ or $R^3$ together form the atoms closing a heterocyclic nucleus, compounds such as N-methyl pyrrolidine and its analogs, etc., which are liquid at the process temperature, are possible. The solvents of the invention can under appropriate circumstances form dimers, etc., for example $(CH_3)_2—N—CO—N(CH_3)—CO—N(CH_3)_2$, and these when liquid can be effective. It is not fully understood why the processes of this present invention accomplish results so strikingly different from the prior art of high-temperature high-pressure extraction utilizing hydrogen donors. However, although it is not intended that the present invention be bound by this explanation, it is believed that the above defined class of solvents extracts the non-fixed carbon by acting as a solvent for the polymeric organic content in the natural material, and also stabilizing electrons and free radicals that are present.

As with the particle size range of oil shale or tar sands, the amount of solvent employed in the present process is not critical, but is primarily governed by practical and economic factors. Indeed, because of the random distribution and combination of organic groups in natural materials, which groups ultimately determine the amount of solvent required for this dissolution, it is virtually impossible to establish in advance any precisely exact amount of solvent needed for essentially complete extraction. Countercurrent extraction or multiple extractions can be envisioned as the present process can occur at low temperatures and at atmospheric pressure. In general, an excess of the solvent is desirable in order to maximize the extraction efficiency, especially bearing in mind the variability in solubility of some of the tar constituents in the solvents of the class in question, which may vary from as small as $10^{-3}$ gm/l to a complete dissolution. Roughly speaking, a useful ratio range of solvent to fossil fuel is about 0.1–10:1 by volume, although these limits are, as stated, not critical.

An important advantage of the present extraction is the avoidance of harsh reaction conditions that would lead to side reactions and/or destructive decomposition of oil shale or tar sands, and any of their derivative products. The selection of a particular temperature for carrying out the present extraction process is influenced by several parameters. First, the temperature must be below that at which any destructive interaction takes place between the extraction solvent and the fixed carbon content of the natural material. Additionally, the temperature should not exceed the boiling point of the solvent at the selected operating pressure. Finally, the extraction temperature should be below that at which thermal degradation or decomposition of oil shale or tar sands begins (generally considered to occur around 400° C. or above). The extraction can be carried out at room temperature, but mild heating may be preferred in order to increase the kinetics of the extraction mechanism. The application of pressure is not necessary in the present process, which offers the practical advantage of allowing the process to be carried out in an open and less expensive system. Modest pressure may tend to increase process efficiency due to the simple mechanical effect of pressure in forcing the solvent into the fixed carbon matrix of the material, but the application of high pressures (for example, with hydrogen gas), as is characteristic of prior art processes for initiating chemical reactions is not needed in the practice of the invention and should be avoided.

As the extraction proceeds, the solvent normally acquires an intense dark coloration from the tar solute, but the absence of this coloration alone does not necessarily indicate the failure to achieve any extraction. Consequently, the solvolysis phase of the present process can be generally taken as complete when the addition of fresh solvent to the oil shale or tar sands at the highest suitable operating temperature brings about no change in the spectral characteristics of the solvent, especially its infrared and ultraviolet light absorptivity, as detected by instrumentation capable of measuring these spectral characteristics.

While this invention is essentially predicated upon the use of a solvent compound of the general formula noted above, no reason is known why the solvent could not, in principle be combined with other conventional solvents or diluents which at least do not impair the unique solvent activity of such solvent compound.

Depending upon the selected starting material, the content of extracted oil and tar will vary for one extraction from about 10 to about 50–60% by weight of the initial material, andd the concentration of the oil or tar solute will naturally depend upon the ratio of solvent to material being treated in the particular embodiment. The mixture of solute and solvent can be separated from the solid residue of the oil shale or tar sands by conventional separation equipment, such as a filter or centrifuge. The liquid phase is then processed to separate the solvent medium to permit its recovery and recycling with attendant cost advantages. Recovery of solvent can be accomplished by crystallization, vacuum distillation or evaporation. An effective technique for this purpose is a so-called mixed solvent precipitation. In this technique, a solubility inverting solvent having a significantly lesser solvent capacity for the dissolved non-fixed carbon content than the novel solvents of the invention is admixed to the liquid phase in sufficient quantities as to bring about salting out or precipitation of the non-fixed carbon content. The precipitated material can then be separated from the mixed liquid phase by decantation, filtration, or centrifugation and the components of the mixed liquid medium separated fron one other by distillation or other conventional fractionation procedures which can have a relatively low energy consumption. The selection of a solubility inverting solvent for this step of the process should pose no problem since a wide variety of solvents has been found useful for this purpose. The preferred solvents include the common lower alcohols such as methanol, ketones such as acetone, diethyl ether or the like. Normally non-polar organic solvents, particularly of the aromatic type, would be expected to be miscible with the dissolved content or oil shale or tar solute, and their failure to do so cannot be fully rationalized. Water itself is useful in principle, although it, as will be explained subsequently, tends to lead to the creation of a colloidal suspension of the solute, making in some instances the ultimate separation of the phases more difficult since the colloid is more resistant to sedimentation than otherwise.

The separated precipitate which has a thick consistency, represents the non-fixed carbon content of the oil shale or tar sands. It is somewhat similar to the tar products obtained in prior art carbonization retorting and/or gasification processes, and is generally adapted for the same end purposes served by these conventional end products—but with the peculiar advantage that valuable chemicals and chemical intermediates contained in the original oil shale or tar sands have been extracted intact in significant amounts. They are, therefore, available for direct recovery or, alternatively, for further chemical processing which can consequently be more positively controlled and directed to produce selected end products than is possible in the random environment of prior art procedures. For example, the separated non-fixed carbon precipitate can be treated with solvents having a preferential dissolving action for selected constituents therein, as already in use in the art, and any remaining unextracted matter can then be used in conventional ways for carbonaceous materials.

As regards to solid material from the extract, this material necessarily contains a certain small residue of solvent therein which desirably is removed and recovered. As separated from the liquid phase, the solid particle residue, with residual solvent, has a rather thick consistency more or less comparable to that of honey and can be suspended by mixing with an aqueous medium, e.g. water or mixtures of water and alcohol, etc., to form a colloidal suspension. The aqueous medium acts as a stripping solvent for the treatment solvents, having a higher attraction, therefore, than for the solid particles so that the residual solvent is stripped from its state of adsorption on the particle surface and is presumably being replaced by water. The aqueous medium can also interact with the fixed carbon matrix and further break down the fixed carbon solid by serving as a proton donor to the now activated fixed carbon matrix and further break down the fixed carbon matrix. The solid particles can be separated from the liquid mixture by a filter, centrifuge or other conventional separation equipment, and the solvent and water mixture can in turn be separated into its component liquids by distillation or other conventional fractionation means which permits the separated liquids to be recycled to minimize liquid consumption in the present process.

The wet particles containing mainly fixed carbon and ask recovered in this process are in a form which is especially advantageous for further utilization, e.g. as combustible fuel comparable to coke. Because the solid fixed carbon particles are free of significant amounts of tar, they tend to react with improved efficiency in these processes without any of the practial difficulties which accompany the presence of tar. Moreover, the stripping of the residual solvent from the particle surface results in activation of these particles with corresponding increase in their reactivity.

The original ash content of the oil shale which is contained within the recovered solid particles is the source of the most original sulfur contamination. If these particles are to serve as a solid fuel, separation of any ash may then be desirable so as to reduce the tendency of the final solid particles to cause atmospheric pollution when combusted. This separation may be accomplished when the solid residue is emulsified in the aqueous media. If the particle size of the fixed carbon is reduced by this processing to the particle size of the mineral matter, the fixed carbon remains dispersed while the mineral matter sinks and can be separated by conventional means, such as centrifuging.

It will be apparent that the particle solids recovered from an initial extraction stage can be again subjected to extraction one or more times, and, indeed, it appears that additional amounts of the oil shale or tar sands solids respond to the repeated solvolysis action, although, of course, at decreasing quantitative rates and it is at least conceivable that substantially all of the carbon content of the natural material can be ultimately extracted, save only for the ash, in this matter.

DESCRIPTION OF EXEMPLARY WORKING SYSTEM

A flow sheet for a typical working system for carrying out the extraction process of the present invention is shown in diagrammatic fashion in the accompanying drawing. In this system, tar sand, oil shale or the like from any selected source is delivered, if necessary, to a pulverizer or mill 10 which reduces the material to the desired particle size. If separation of the fines and oversize material is advisable, this may be accomplished by means of any conventional screening system, not shown in the drawing. The sub-divided material of the desired particle size or size range is then introduced into a dissolver 12 for admixture with the novel solvent medium according to the invention in selected proportions. Ideally, the great bulk of the extraction solvent needed to make up for unavoidable loss of solvent during processing can be added through a make-up line 14. In dissolver 12, the solvent and finely-divided oil shale or tar sands are agitated under the selected conditions of temperature and pressure within the general limits described above for a period of time necessary to extract a substantial amount of the non-fixed carbon content from the material. The outlet 16 of dissolver 12 delivers the suspension of extracted oil shale or tar sands particles in the solvent solution of the extracted non-fixed carbon matter to a separator such as a filter or centrifuge capable of effecting separation of the liquid phase from the solid phase. The solid phase consisting of the fixed carbon content of the oil shale together with the ash, which contains non-carbon mineral compounds such as kaolinite, etc., leaves the separator 18 through line 20 for conveyance to a mixture/decanter 22 where it is admixed with an excess of a liquid medium, which can be water, to form a colloidal suspension of the solid particles in the mixture of liquid and residual solvent stripped off the particles, and this colloidal suspension is passed via line 24 to washer 26 to dilute the extraction solvent concentration in the liquid in contact with the solids by the addition of more stripping solvent preferably recovered from the mixer/decanter. The overflow liquid 28 is returned to the mixer/decanter 22. The bottom solids are delivered via line 30 to separator 32, e.g. a filter or centrifuge, where excess aqueous solution is removed from the solid particle phase and returned by line 34 to the washer 26. As the densities of the fixed carbon content and mineral matter are different, the two solids may be separated by conventional techniques if desired. The solid particles which are somewhat analogous to activated carbons, are then ready for use for any purpose to which the activated carbons and related materials are known to be adapted. The excess liquid from the initial aqueous medium mixer/decanter 22 is decanted and delivered by line 36 to distillation column 38. The fractionator 38 separates the aqueous medium from the extraction solvent, and the aqueous medium is recycled to the washer 26 by line 40. The extraction solvent is recycled by line 42 to the dissolver 12.

The effluent from separator 18 formed of the solution of non-fixed carbon in the extraction solvent passes by a line 44 to mixer 46 for admixture therewith of an alcohol or like inversion solvent liquid which is miscible with the treatment solvent liquid but of significantly lower solvent capacity for the dissolved non-fixed carbon matter so that the dissolved non-fixed carbon content is no longer held in solution in mixture but is salted or precipitated out as a thick, dark liquid. This thick phase can be separated in a separator 48 (or decanted in mixer 46 if preferred) and collected by line 50 for further processing as extraction and/or fractionation and the like.

The ligher phase is taken from the separator 48 to a fractionator, e.g. a distillation column or evaporator 52 for separation of the extraction solvent and the inversion solvent to permit these to be recycled by line 54 to the initial dissolving stage 12 and by line 56 to the inversion mixing stage 46.

Alternatively, the solute phase from separator 18 containing the non-fixed carbon can be delivered directly to fractionator 52 as indicated by dotted line 58 and the extracted non-fixed carbon is taken from the bottom of the fractionator 52 as indicated by dotted line 60. At lower temperatures, the more volatile solvent is boiled off, leaving the non-fixed carbon in solid form. The extraction solvent is recycled as before.

EXAMPLES

1. Several 2 gram samples of two organic-containing tar sands from Alberta, Canada, one being Athabasca tar sand and one being Cold Lake tar sand, were mixed with 4 grams of tetramethylurea (TMU) and with 4 grams of hexamethylphosphoramide (HMPA). The mixtures were stirred and filtered. The residues were washed with an additional 1.5 grams of TMU, filtered and dried with acetone. The 1.23 grams of residue had the appearance of white sea sand. The combined TMU filtrates were deep brown in color, indicating tars had been dissolved. Upon addition of 10 mls of $H_2O$ to the TMU filtrates, a black, tar-like precipitate was produced. This mixture was filtered. The residue was a black filter cake, and the filtrate was a colorless liquid. The filter cake was rinsed with $H_2O$, dried and weighed. The filtrate liquid was distilled to remove the $H_2O$ and the less volatile portion was recovered. These data are tabulated below:

TAR SAND EXTRACTION EXPERIMENTS

| Source | Initial weight of tar sand | Weight after extraction | % Weight extracted | % Organic matter in sand | Grams liquid recovered |
|---|---|---|---|---|---|
| Athabasca | 2.00 | 1.24 | 37.5% | 39% | 6.1 HMPA |
| tar sand | 2.00 | 1.30 | 35% | 39% | 6.0 TMU |
| Cold Lake | 2.00 | 1.75 | 12.5% | 14.3% | 5.9 HMPA |
| tar sand | 2.00 | 1.82 | 9% | 14.3% | 5.7 TMU |

2. Samples of two oil shales were mixed with hexamethylphosphoramide (HMPA) and refluxed for approximately 25 minutes in an effort to extract the oil content of the shale into the liquor. The suspensions were filtered and washed. The residues were washed with water and dried in a vacuum dessicator until constant weight was obtained. The weight of the original sample was divided into the weight of the sample after extraction to give percent solubility. These data are tabulated below:

OIL SHALE EXTRACTION EXPERIMENT

| Origin | Initial Weight(Gms) | Average Recovered Weight(Gms) | Average % Weight Extracted | % Organic Matter Shale |
|---|---|---|---|---|
| Colorado | 2.00 | 1.80 | 10% | 8% |
| Tennessee | 1.84 | 1.70 | 2% | 4% |

The extracted weights may also have some error as the residues gain weight rapidly by moisture absorption on exposure to air. The results in the Table demonstrate the effectiveness of the solvent in extracting organic material from oil shales. The filtrate was a black liquor, from which a waxy material precipitated upon addition of $H_2O$.

What is claimed is:

1. A process of substantially extracting non-fixed carbon content of tar sands and oil shale containing fixed carbon and non-fixed carbon therein, which comprises the steps of agitating said tar sands or oil shale in sub-divided form in a solvent liquid comprising a compound of the general formula:

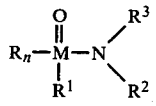

where

M is a carbon, sulfur, or phosphorus atom, $R^2$ and $R^3$ are each a hydrogen atom or a lower alkyl group, R and $R^1$ are each a lower alkyl group, another

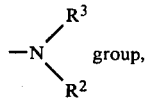

a monocyclic aromatic group, or $R^1$ can be another

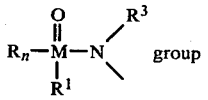

or $R^1$ and $R^2$ together can represent the atoms necessary to close a heterocyclic ring, and n=1 where M-phosphorus and is otherwise 0, at a temperature below the decomposition temperature of tar sands or oil shale until a substantial amount of said non-fixed carbon content is dissolved in said solvent, and separating the undissolved solid matter including fixed carbon from said solvent liquid containing non-fixed carbon dissolved therein.

2. The process of claim 1 wherein said tar sands or oil shale and solvent liquid are agitated under generally atmospheric pressure.

3. The process of claim 1 wherein said tar sands or oil shale and solvent liquid are agitated at a temperature in the range of about 20°-300° C.

4. The process of claim 1 wherein said oil shale has a particle size smaller than about 10 mesh.

5. The process of claim 1 where said solvent is present in a ratio by volume to said tar sands or oil shale of about 1-10:1.

6. The process of claim 1, including the steps of separating the dissolved non-fixed carbon from extraction solvent liquid and recycling said separated extraction solvent liquid for further agitation with fresh material.

7. The process of claim 6 wherein said extraction solvent liquid is separated by admixing a solubility inversion solvent to the solution of non-fixed carbon in said extraction solvent in sufficient amount to precipitate said non-fixed carbon solute from said solvent mixture separating said extraction solvent from said solvent mixture by fractionation, and recycling the thus-separated extraction solvent.

8. The process of claim 6 wherein said extraction solvent liquid is separated by evaporation, leaving a non-fixed carbon residue and recycling the extraction solvent liquid.

9. The process of claim 1 including the steps of suspending the thus-separated undissolved solid matter in a solvent-stripping liquid medium to separate said solid matter from said solvent-medium mixture and subjecting said solvent-medium mixture to fractionation for separating said medium and solvent from one another for recycling.

* * * * *